US005203739A

United States Patent [19]

Neubauer

[11] Patent Number: 5,203,739

[45] Date of Patent: Apr. 20, 1993

[54] MAILER FORM HAVING A PROTECTED IMAGE TRANSFER MEDIUM

[75] Inventor: Frank Neubauer, Mount Kisco, N.Y.

[73] Assignee: Transkrit Corporation, Brewster, N.Y.

[21] Appl. No.: 855,265

[22] Filed: Mar. 23, 1992

[51] Int. Cl.[5] ..... B41L 1/20

[52] U.S. Cl. ..... 462/6; 462/39; 283/116

[58] Field of Search ..... 462/6, 26, 28, 36, 39; 283/116; 229/72

[56] References Cited

U.S. PATENT DOCUMENTS 2,670,971 3/1954 Johnson ..... 462/39

4,165,101 8/1979 Sternberg ..... 283/116 X 4,597,591 7/1986 Gendron et al. ..... 283/116

5,076,489 12/1991 Steidinger ..... 462/6

5,092,514 3/1992 Van Malderghem et al. ..... 462/6

*Primary Examiner*—Timothy V. Eley

*Assistant Examiner*—William Fridie, Jr.

*Attorney, Agent, or Firm*—Francis C. Hand

[57] ABSTRACT

The image transfer medium, such as a carbon spot or microcapsule type of medium is provided with a protective overcoat which precludes smudging of an insert ply within the mailer form due to the rubbing of the face of the mailer form. The overcoat serves to preclude or greatly reduce an image transfer under a transversely applied rubbing force while allowing transfer of an image under impact force.

14 Claims, 1 Drawing Sheet

Fig. 1.
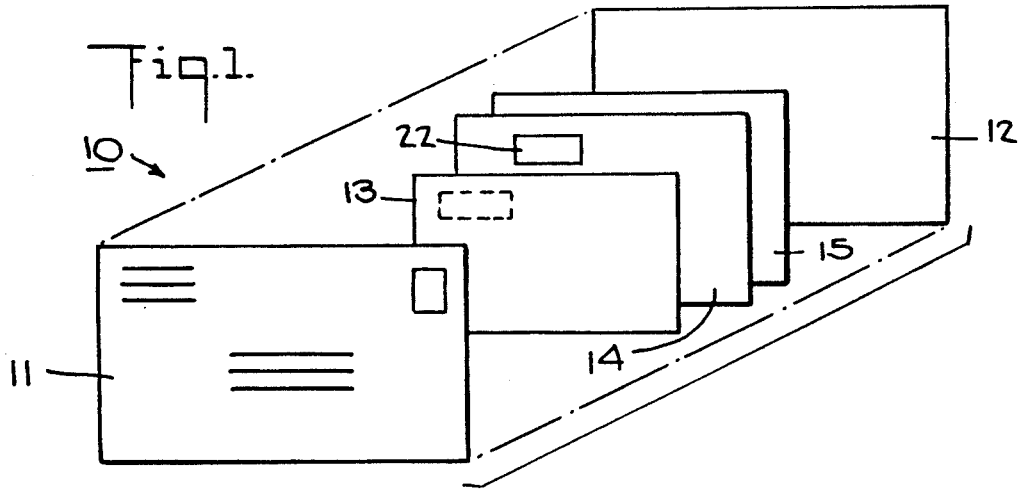
Fig. 2.
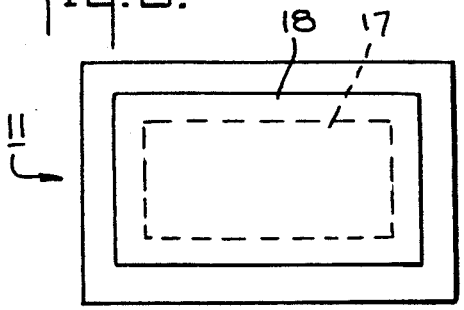
Fig. 3
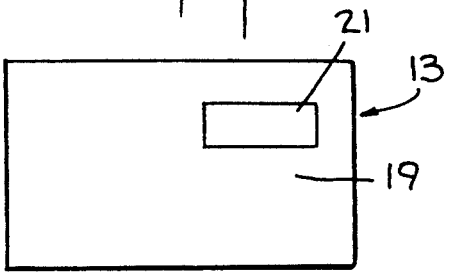
Fig. 4.
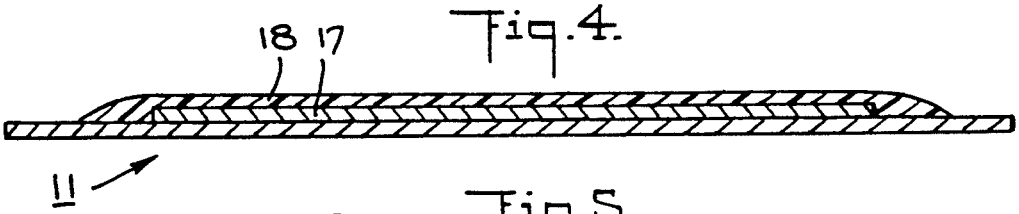
Fig. 5.
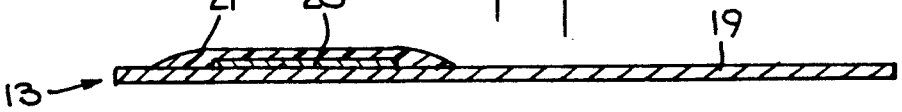
Fig. 6.
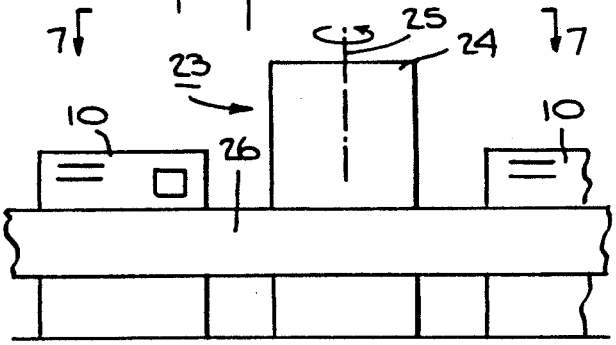
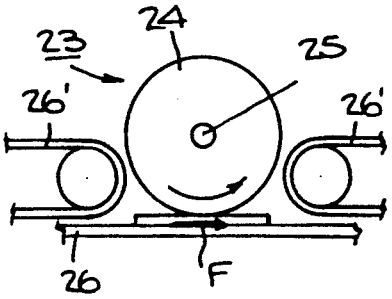
Fig. 7.

MAILER FORM HAVING A PROTECTED IMAGE TRANSFER MEDIUM

This invention relates to a mailer form having a protected image transfer medium.

As is known, various types of prestuffed mailer forms have been made which employ a front ply, a back ply secured to the front ply to form an envelope and one or more inserts within the envelope. In addition, it has been known to provide the rear surface of the front ply with a carbon spot or other image transfer medium so that an image imposed on the front ply by an impact printer or other stylus can be transferred onto the insert ply. A number of variations of such a mailer construction are also known, for example wherein the insert ply is provided with a carbon spot or image transfer medium on a rear surface so as to transfer an image onto the face of a return envelope ply under the impact of a stylus.

It has also been known that when such mailer forms are processed in high speed devices such as sorters and cancelers as are now available to the postal authorities, the inserts have become smudged due to the friction from the transfer belts of such devices on the surfaces of the mailer forms. That is, such devices have relied upon belts to transfer a series of mailer forms or envelopes past a drum so that the forms and envelopes can be sorted at a downstream point or cancelled. In some cases, the forms and envelopes are simply run in a rectilinear path past the drum while in other cases, the transfer belts have been wrapped in part about the drums. In either case, it has been found that the transfer belts severly smudge the carbon spots or other image transfer medium within the mailer form to such an extent that the inserts become very dirty and sometimes illegible.

Accordingly, it is an object of the invention to greatly reduce or prevent smudging of inserts within a mailer form utilizing an image transfer medium within the form for transferring an image onto the insert and/or other plies.

It is another object of the invention to provide a relatively simple technique to greatly reduce or prevent smudging of an insert within a mailer form by a carbon transfer spot without affecting the purpose intended for the carbon transfer spot.

It is another object of the invention to provide a relatively simple technique to protect against smudging of an transfer medium onto an internal ply of a mailer form during processing on high speed sorting equipment.

Briefly, the invention is directed to a mailer form comprising at least a front ply having a front face for impacting of an imaging means thereon, a back ply secured to the front ply to define a pocket therewith and at least one insert ply disposed in the pocket between the front and back plies. In addition, an image transfer medium is disposed on a rear face of the front ply for transferring an image imposed on the front ply under an impact force of an imaging means onto the insert ply.

In accordance with the invention, an overcoat is provided over at least a part of the transfer medium on the rear of the front ply in order to preclude or greatly reduce transfer of an image imposed on the front ply under a transversely applied force onto the insert ply while transferring an image imposed on the front ply under an impact force onto the insert ply. That is, the overcoat allows an image to be transferred onto the insert ply by means of an impact force such as generated by an impact printer or other stylus while, at the same time, precluding a force which is applied transversely of the front ply, for example by a relative sliding motion of a transfer belt of a postal sorter across the face of the front ply (or back ply) from transferring an image.

Said another way, the overcoat disposed over the transfer medium precludes or greatly reduces unwanted stray release of the image transfer medium under a transversely applied shear force on the front ply (or back ply) while permitting release of the image transfer medium under an impact force onto the insert ply.

The overcoat is characterized in being sufficiently soft to permit an impact stylus or the like to release the image transfer medium so as to form an image on an insert ply while at the same time being sufficiently hard so as to prevent release of the image transfer medium under a shear force. In this respect, the overcoat may be a wax, such as a carnauba wax, a paraffin wax or the like. The carnauba wax may be applied in the form of a nonionic wax emulsion sold under the trademark MICHEM ® LUBE 156 by Michelman, Inc. of Cincinnati, Ohio. Such a nonionic wax emulsion contains a carnauba wax in water with a total solids content of from 24.5 to 25.5 percent. In addition, the emulsion is characterized as having a viscosity of less than 15 cps. (No. 1 Spindle at 60 rmp) while also having a pH of from 4.0 to 6.0. The weight of a gallon of such an emulsion is between 8.3 and 8.4 pounds. Any other suitable vehicle may be used for applying the wax. Also, the wax may be directly applied without a carrier.

These and other objects and advantages of the invention will become more apparent from the following detailed description taken in conjuction with the accompanying drawings wherein:

FIG. 1 illustrates an exploded view of a mailer form constructed in accordance with the invention;

FIG. 2 illustrates a view of the rear face of the front ply of FIG. 1 provided with a carbon spot image transfer medium and an overcoat in accordance with the invention;

FIG. 3 illustrates a view of a rear face of the insert ply of FIG. 1 in accordance with the invention;

FIG. 4 illustrates a cross sectional view of the front ply of FIGS. 1 and 2;

FIG. 5 illustrates a cross sectional view of the insert ply of FIGS. 1 and 3;

FIG. 6 illustrates a schematic view of a postal sorter during operation; and FIG. 7 illustrates a plan view of the sorter of FIG. 6.

Referring to FIG. 1, the mailer form 10 is generally conventional structure and is comprised of a front ply 11, a back ply 12, at least one insert ply 13 and a return envelope formed of two plies 14, 15 which are secured together in any known manner. The mailer 10 is of a conventional structure and may be supplied to a user in the form of a continuous mailer assembly as is well known. As indicated, the front ply 11 is of rectangular shape and has a front face for impacting of an imaging means such as an impact printer or stylus thereon. As schematically indicated, addressor and addressee information can be imaged on the front face of the front ply 11.

The back ply 12 is secured to the front ply 11, for example by lines of glue (not shown) or other suitable securing means in order to define a pocket therewith. As indicated, the back ply 12 is of rectangular shape.

The insert ply 13 is also of a rectangular shape and is disposed in the pocket between the front and back plies 11, 12. The insert ply 13 may be held in place by fugitive glue spots or in any other suitable fashion.

The return envelope plies 14, 15 are of rectangular shape and are suitably structured to function as a return mail envelope.

Referring to FIG. 2, the front ply 11 is provided with an image transfer medium 17 on the rear face. The image transfer medium 17 may be in the form of a layer of carbon, for example, having a thickness of from 2 to 10 microns and may be formed in a rectangular block shape to cover a substantial portion of the rear face of the front ply 11. Alternatively, the transfer medium may be disposed in separate spaced apart blocks on the rear face of the front ply 11. Still further, the transfer medium 17 may be formed of a layer containing microcapsules of an image transfer material as is well known in the art.

Referring to FIGS. 2 and 4, an overcoat 18 is provided over at least a part of the transfer medium 17. In the example illustrated, the overcoat 18 extends beyond the image transfer medium 17 and adheres directly to the rear surface of the front ply 11. This overcoat 18 is characterized as being able to preclude transfer of an image imposed on the front ply 11 under a transversely applied force, that is, a shear or friction force, onto the insert ply 13 while transferring an image imposed on the front ply under an impact force, such as imposed by an impact stylus onto the insert ply 13. The overcoat 18 may be applied over the entire area of the transfer medium 17 or only over a portion of the transfer medium 17. This may depend upon the areas of the front ply 11 which would be most likely to be subjected to a transversely applied force, i.e. a shear force. In the preferred embodiment, the overcoat 18 overlaps or exceeds the boundary of the transfer medium 17.

Referring to FIGS. 3 and 5, the rear faces 19 of the insert ply 13 may also be provided with an image transfer medium 20 (FIG. 5) in a localized area as well as with an overcoat 21 over the image transfer medium 20. The transfer medium 20 on the insert ply 13 can be used to transfer an image onto a block 22 on the front face of the first ply 14 of the return envelope as indicated in FIG. 1. However, the overcoat 21 serves, as above, to preclude transfer of an image imposed on the front ply 11 under a transversely applied shear force onto the front face of the return envelope 14, 15 while being able to transfer an image imposed on the front ply 11 under an impact force onto the front face of the ply 14 of the return envelope via the image transfer medium 20.

Referring to FIGS. 6 and 7, the mailer form 10 can be automatically processed in a postal sorter 23 as is known which operates at a high speed. For example, the sorter 23 includes a sorter drum 24 which is rotatably about a fixed axis 25 for reading the imaging on the face of a mailer form 10 for sorting purposes downstream of the drum 24. As indicated, transfer belts 26 are provided to transfer the mailer at a high speed to a position between a transfer belt 26 and the drum 24.

As schematically indicated in FIG. 7, an endless belt 26' cooperates with the transfer belt 26 to convey a series of mailers 10 sequentially to the rotating drum 24 while a second endless belt 26' cooperates with the main transfer belt 26 to convey the mailers 10 beyond the drum 24.

During transfer of the mailer forms between the belts 26, 26' and between the belt 26 and drum 24, slippage may take place between the belts 26, 26' or between the belt 26 and drum 24. As a result, a transversely applied force, i.e. a friction or shear force F is imposed on the mailer form 10 (see FIG. 7). Without the overcoat 18 on the rear face of the front ply 11, the transversely applied force F would cause a stray release of the image transfer medium, i.e. carbon, and thus form a smudged image on the face of the insert ply 13. Likewise, where the insert ply 13 may have an image transfer medium 20 on the rear face 19 (see FIGS. 3 and 5), a smudged image may be formed on the front face of the ply 14 of the return envelope under the transfer medium 20.

However, the overcoat 18 on the front ply 11 and the overcoat 21 on the rear face of the insert ply 13 preclude or reduce any stray release of the image transfer mediums from the respective plies 11, 13.

The overcoat 18 which is applied on the front ply 11 allows an impact force on the face of the front ply 11 to create an image on the insert ply 13 by releasing the image transfer medium 17 through the overcoat 18 onto the insert ply 13. Likewise, an impact force over the transfer medium 20 of the insert ply 13 will effect formation of an image within the block 22 of the front face of the back ply 14.

The overcoat 18 which is applied on the rear face of the front ply 11 over the transfer medium 17 may have a thickness of from 2 to 10 microns. For example, as described above, the overcoat may be nonionic wax emulsion containing a carnauba wax.

Other types of overcoats or overcoat mediums may well be applied over the transfer medium for the purposes intended. For example, such an overcoat medium would be characterized as one which precludes unwanted stray release of the image transfer medium under a transversely applied force on the face of the front ply (or back ply) while permitting release of the image transfer medium under an impact force on the face of the front ply 11 to form an image on the insert ply 13.

The overcoat 18, 21 serves to prevent or greatly reduce smudging of carbon where carbon is used as an image transfer medium or premature rupture of microcapsules where the image transfer medium contains microcapsules of an image transfer material.

The invention thus provides a relatively simple technique for precluding smudging of images due to processing through a postal sorter.

The invention further provides a relatively simple technique to avoid an image transfer under a transversely applied force, such as by rubbing across the face of a mailer form, onto the surface of an insert ply within the mailer form.

What is claimed is:

1. A mailer form comprising a front ply having a front face for impacting of an imaging means thereon and a rear face;

a back ply secured to said front ply to define a pocket therewith;

at least one insert ply disposed in said pocket between said front ply and said back ply;

an image transfer medium on said rear face of said front ply for transferring an image imposed on said front ply under an impact force of an imaging means onto said insert ply; and an overcoat over at least a part of said transfer medium to reduce transfer of an image imposed on said front ply under a transversely applied force onto said insert ply while transferring an image imposed on said front ply under an impact force onto said insert ply.

2. A mailer form as set forth in claim 1 wherein said overcoat is made of a carnauba wax.

3. A mailer form as set forth in claim 2 wherein said overcoat has a thickness of from 2 to 10 microns.

4. A mailer form as set forth in claim 1 wherein said coat is made of a paraffin wax.

5. A mailer as set forth in claim 1 wherein said coat is made of a nonionic wax emulsion.

6. A mailer form as set forth in claim 5 wherein said overcoat has a thickness of from 2 to 10 microns.

7. A mailer form as set forth in claim 1 wherein said transfer medium is a layer of carbon having a thickness of from 2 to 10 microns.

8. A mailer form as set forth in claim 1 wherein said transfer medium is a layer containing microcapsules of image transfer material.

9. A mailer form as set forth in claim 1 which further comprises a return envelope between said insert ply and said back ply and wherein said insert ply has a rear face facing said return envelope and which further includes a second image transfer medium on said rear face of said insert ply for transferring an image imposed on said front ply under an impact force onto said return envelope and a second overcoat over at least a part of said second image transfer medium to preclude transfer of an image imposed on said front ply under a transversely applied shear force while transferring an image imposed on said front ply under an impact force of an imaging means onto said return envelope.

10. A mailer form comprising a front ply having a front face for impacting of an imaging means thereon and a rear face;

a back ply secured to said front ply to define a pocket therewith;

at least one insert ply disposed in said pocket between said front ply and said back ply;

an image transfer medium on said rear face of said front ply for transferring an image imposed on said front ply under an impact force of an imaging means onto said insert ply; and an overcoat over at least a part of said transfer medium to reduce unwanted stray release of said image transfer medium under a transversely applied shear force on said front ply while permitting release of said image transfer medium under an impact force onto said insert ply.

11. A mailer form as set forth in claim 10 wherein said transfer medium is a layer of carbon having a thickness of from 2 to 10 microns and said overcoat has a thickness of from 2 to 10 microns.

12. A mailer form as set forth in claim 10 wherein said overcoat is made of carnauba wax.

13. A mailer form as set forth in claim 10 wherein said overcoat is made of a paraffin wax.

14. A mailer form as set forth in claim 10 wherein said overcoat is made of a nonionic wax emulsion.

* * * * *